US006229900B1

(12) United States Patent
Leenen

(10) Patent No.: US 6,229,900 B1
(45) Date of Patent: May 8, 2001

(54) HEARING AID INCLUDING A PROGRAMMABLE PROCESSOR

(75) Inventor: Joseph R. G. M. Leenen, Veldhoven (NL)

(73) Assignee: Beltone Netherlands B.V. (NL)

( * ) Notice: Subject to any disclaimer, the term of this patent is extended or adjusted under 35 U.S.C. 154(b) by 0 days.

(21) Appl. No.: 09/015,883

(22) Filed: Jan. 29, 1998

(30) Foreign Application Priority Data

Jul. 18, 1997 (WO) ..... PCT/IB97/00899

(51) Int. Cl.[7] ..... H04R 25/00
(52) U.S. Cl. ..... 381/314; 381/312
(58) Field of Search ..... 381/312, 315, 381/314, 320, 321, 323, 60

(56) References Cited

U.S. PATENT DOCUMENTS 4,989,251 * 1/1991 Mangold .
5,083,312 * 1/1992 Newton et al. .
5,202,927 * 4/1993 Topholm .

FOREIGN PATENT DOCUMENTS 3642828 10/1989 (DE) ..... H04R/25/00
WO8904583 5/1989 (EP) ..... H04R/25/00

OTHER PUBLICATIONS

"A Single Battery, 0.9V–Opearted Digital Sound Processing IC Including AD/DA and IR Receiver with 2mW Power Consumption" by Harry Neuteboom et al; ISSCC97/Session 6/Low–Power and Mixed–Signal Processing/Paper TP6.4; 1997 IEEE International Solkid–Statie Circuits Conference.

* cited by examiner

*Primary Examiner*—Huyen Le
*Assistant Examiner*—P. Dabney
(74) *Attorney, Agent, or Firm*—McDermott, Will & Emery

(57) ABSTRACT

A hearing aid comprises a programmable processor, a first memory device and a receiver which is coupled thereto and which serves to receive control signals from a remote control. The remote control comprises a transmitter for sending control signals to the hearing aid. A set of instructions which can be executed by the programmable processor can be sent to the hearing aid by the remote control via the control signals. The hearing aid is designed so as to store the control signals in the first memory means.

8 Claims, 2 Drawing Sheets

HEARING AID INCLUDING A PROGRAMMABLE PROCESSOR

BACKGROUND OF THE INVENTION

This invention relates to a hearing aid comprising a first memory means and a receiver which is coupled thereto and which serves to receive control signals from a remote control, which hearing aid is arranged so as to store the control signals in the first memory means.

The invention also relates to a remote control for controlling such a hearing aid, which remote control comprises a transmitter.

The invention further relates to a system comprising at least one such hearing aid and such a remote control.

Such a hearing aid is disclosed in DE-C 3 642 828. The hearing aid disclosed in said German patent specification comprises a number of signal-processing elements, such as filters and amplifiers, which are incorporated in the signal path between, on the one hand, a microphone or a telephone coil and, on the other hand, a loudspeaker. The transfer function of each of these signal-processing elements can be controlled by means of a number of parameters. The overall transfer function of the known hearing aid, i.e. the transfer function of the microphone or the telephone coil to the loudspeaker, is determined by means of a set of parameters in which all parameters for the individual signal-processing elements are collected. In a wireless remote control associated with the known hearing aid, a number of these sets of parameters can be stored. By means of the remote control, a user can select one of the sets of parameters contained in the remote control and send them to the hearing aid. Subsequently, the transfer function of the known hearing aid is determined by the new set of parameters. This construction enables the user to adapt the hearing aid to different sound conditions. In the known hearing aid, the position of the signal-processing elements in the signal path is fixed. As a result, a user cannot readily change the total transfer function of the known hearing aid in a flexible manner.

OBJECTS AND SUMMARY OF THE INVENTION

It is an object of the invention to provide a hearing aid of the type mentioned in the opening paragraph, by means of which the total transfer function of the hearing aid can be flexibly changed by the user. To achieve this, the hearing aid in accordance with the invention is characterized in that the hearing aid further comprises a programmable processor, and the control signals include a first set of instructions which can be executed by the programmable processor.

The combination of a programmable processor and a set of instructions which can be executed by this programmable processor enables the transfer function of the hearing aid to be adapted in a relatively flexible manner. The sequence of the signal-processing operations and the number of times that a specific signal-processing operation is executed are not fixed. A different transfer function can be selected by loading a different set of instructions into the hearing aid via a remote control.

In WO 89/04583, a description is given of a hearing aid which is connected to a remote control by means of a number of wires. The remote control is provided with a programmable processor and a memory. A set of instructions which can be carried out by the programmable processor and a number of sets of parameters can be stored in the memory. A user can select one of the stored sets of parameters by means of a remote control so that the execution of the set of instructions by the programmable processor is influenced. In the known hearing aid, the programmable processor is incorporated in the remote control, whereas, in the case of the invention, the programmable processor is arranged in the hearing aid. In addition, in the case of the known hearing aid, the user cannot replace the set of instructions to be carried out by the programmable processor by another set of instructions. As a result, a flexible adaptation of the total transfer function is not readily possible in this known hearing aid.

The remote control in accordance with the invention, which comprises a transmitter, is characterized in that the remote control can be coupled to a device for loading, into the remote control, at least one set of instructions which can be executed by a programmable processor, with the transmitter being arranged so as to send the set of instructions which can be executed by the programmable processor to the hearing aid.

By virtue thereof, the transfer function of the hearing aid can readily be adapted to different audio conditions by the user. For a number of these sound conditions a transfer function of the hearing aid is determined which is adapted to the user. Subsequently, a set of instructions which can be executed by the programmable processor and which corresponds to one of these transfer functions can be loaded into the remote control of the user. The user can send this set of instructions to the hearing aid via a transmitter in the remote control, and, in this manner, the user can adapt the transfer function of the hearing aid in a simple manner.

An embodiment of the remote control in accordance with the invention is characterized in that the remote control is embodied so as to store at least a first and a second set of instructions which can be executed by the programmable processor. This enables a number of different instruction sets, corresponding to just as many different sound conditions, to be loaded into the remote control. This has the advantage that the user can independently adapt the transfer function of the hearing aid to other sound conditions by sending one of the instruction sets stored in the remote control to the hearing aid.

A further embodiment of the remote control in accordance with the invention is characterized in that the remote control comprises at least one selection means for selecting one of the stored sets of instructions which can be executed by the programmable processor and which are to be sent to the hearing aid. By virtue thereof, the user can select a set of instructions which are suitable under the prevailing sound conditions, and the user can send this instruction set to the hearing aid, so that the transfer function of the hearing aid is adapted to the sound conditions.

A further embodiment of the remote control in accordance with the invention, which remote control is also embodied so as to control a further hearing aid, which further hearing aid comprises a further programmable processor, is characterized in that the remote control comprises a single selection means for selecting a set of instructions which can be executed by the programmable processor and which are to be sent to the hearing aid, and for selecting a further set of instructions which can be executed by the further programmable processor and which are to be sent to the further hearing aid. This has the advantage that the user, which has a hearing aid for both ears, can set the transfer functions of both hearing aids with a single selection. In this connection, the set of instructions does not have to be equal to the further set of instructions.

These and other aspects of the invention will be apparent from and elucidated with reference to the embodiments described hereinafter.

DETAILED DESCRIPTION OF THE PREFERRED EMBODIMENT

Figure 1:
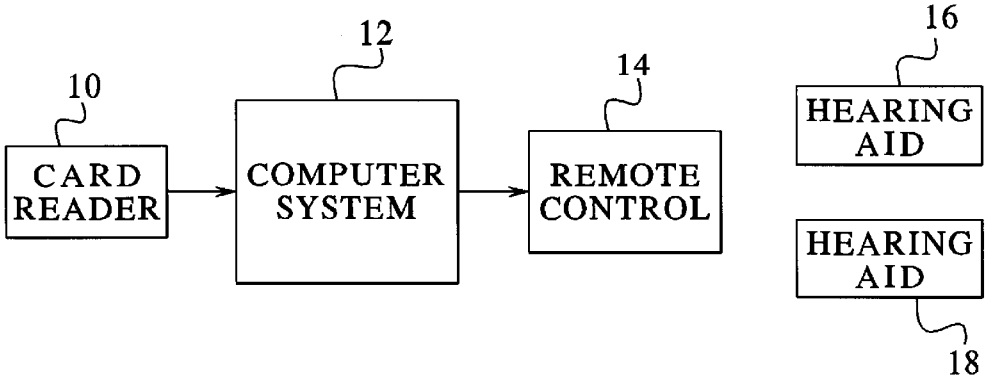
FIG. 1 shows a block diagram of an example of a hearing system comprising a hearing aid and a remote control in accordance with the invention.

The hearing system shown in FIG. 1 comprises a card reader 10, a computer system 12, a remote control 14 and two hearing aids 16 and 18. The computer system 12 is a device which serves to load at least one hearing algorithm into the remote control 14. A hearing algorithm comprises a set of instructions which can be executed by a programmable processor which is incorporated in the hearing aid 16, 18. By execution of the set of instructions belonging to a hearing algorithm in the hearing aid 16, 18, a desired transfer function of the hearing aid 16, 18 is realized.

The computer system 12 and the card reader 10 coupled thereto are embodied so as to be used by a hearing-aid fitter, for example, an audiologist. The hearing-aid fitter has a number of smart cards on which hearing algorithms are stored. Each one of these hearing algorithms corresponds to a specific transfer function of the hearing aid 16, 18

After the hearing-aid fitter has determined the hearing characteristics of an ear of a hearing-impaired patient, the hearing-aid fitter can select, from the available hearing algorithms, a hearing algorithm which is suitable for this ear under specific sound conditions. This means that the hearing-aid fitter selects a hearing algorithm which corresponds to a transfer function of the hearing aid 16, 18, thus enabling the hearing deficiency of the ear demonstrated by the hearing characteristics to be corrected to the extent possible under the above-mentioned sound conditions.

By means of a program which can be executed by the computer system 12, the hearing-aid fitter can, subsequently, read the selected hearing algorithm from the smart card and adapt it. For this purpose, the smart card containing the selected hearing algorithm must first be introduced into the card reader 10. Subsequently, by means of the program the hearing algorithm can be read from the smart card and loaded into the computer system 12. Next, the hearing-aid fitter can adapt the selected hearing algorithm by means of the program so as to achieve a fine adjustment of the transfer function of the hearing aid 16, 18 corresponding to the hearing algorithm.

In general, the above-described process of selecting and adapting hearing algorithms will have to be repeated a number of times by the hearing-aid fitter. Said number is equal to the product of, on the one hand, the number of ears for which the patient requires a hearing aid 16, 18 and, on the other hand, the number of different sound conditions for which an adaptation of the transfer function of the hearing aid 16, 18 is desirable. This can be explained by means of an example. Let us assume that the patient needs a hearing aid 16, 18 for both ears, and that after examination and consultation with the patient it has been decided that setting the transfer function of the hearing aid 16, 18 for two different audio conditions is desirable. This means that, in this example, the hearing-aid fitter has to select and adapt four (=two ears×two sound conditions) hearing algorithms.

The selected and adapted hearing algorithms can subsequently be loaded into the remote control 14 by means of the program. For this purpose, the remote control 14 can be coupled to the computer system 12, for example, by means of a serial connecting cable. After all hearing algorithms have been loaded into the remote control 14, the connection between the remote control 14 and the computer system 12 can be interrupted.

The patient can now control the hearing aid 16, 18 by means of the remote control 14. If necessary, one remote control 14 suffices to control two hearing aids 16, 18.

To control the hearing aid 16, 18, the remote control 14 comprises a transmitter for sending reference or control signals to the hearing aid 16, 18. To receive the reference or control signals, the hearing aid 16, 18 is provided with a suitable receiver.

The reference or control signals may be in the form of infrared signals, ultrasonic sound signals or radio signals. It is alternatively possible to send the reference or control signals from the remote control 14 to the hearing aid 16, 18 via wires.

A number of different functions of the hearing aid 16, 18 can be set by the patient via the remote control 14. First, the patient can control the volume of the hearing aid 16, 18. Second, as the hearing aid 16, 18 may comprise both a microphone and a telephone coil, the patient can select a sound-reception source. In this case, the telephone coil can suitably be used as a sound-reception source in situations in which a special means for inductively transferring acoustic information is available. This is the case, for example, during a telephone call or in a room provided with a ring circuit. The microphone can be used as a sound-reception source in all situations. By means of the remote control 14, the patient can choose the microphone, the telephone coil or the microphone and the telephone coil as a sound-reception source.

And third, the patient can adapt the setting of the hearing aid 16, 18 for use under specific sound conditions. To this end, the patient can select a selection means of the remote control 14 which is coupled to these specific sound conditions, whereafter the associated hearing algorithm or the associated hearing algorithms are sent to the hearing aid 16, 18.

And fourth, the patient can put the hearing aid into a stand-by state. In this state, the hearing aid 16, 18 is in the off-position. In this state, the energy consumption of the hearing aid 16, 18 is minimal, while all settings of the hearing aid 16, 18 are preserved.

Figure 2:
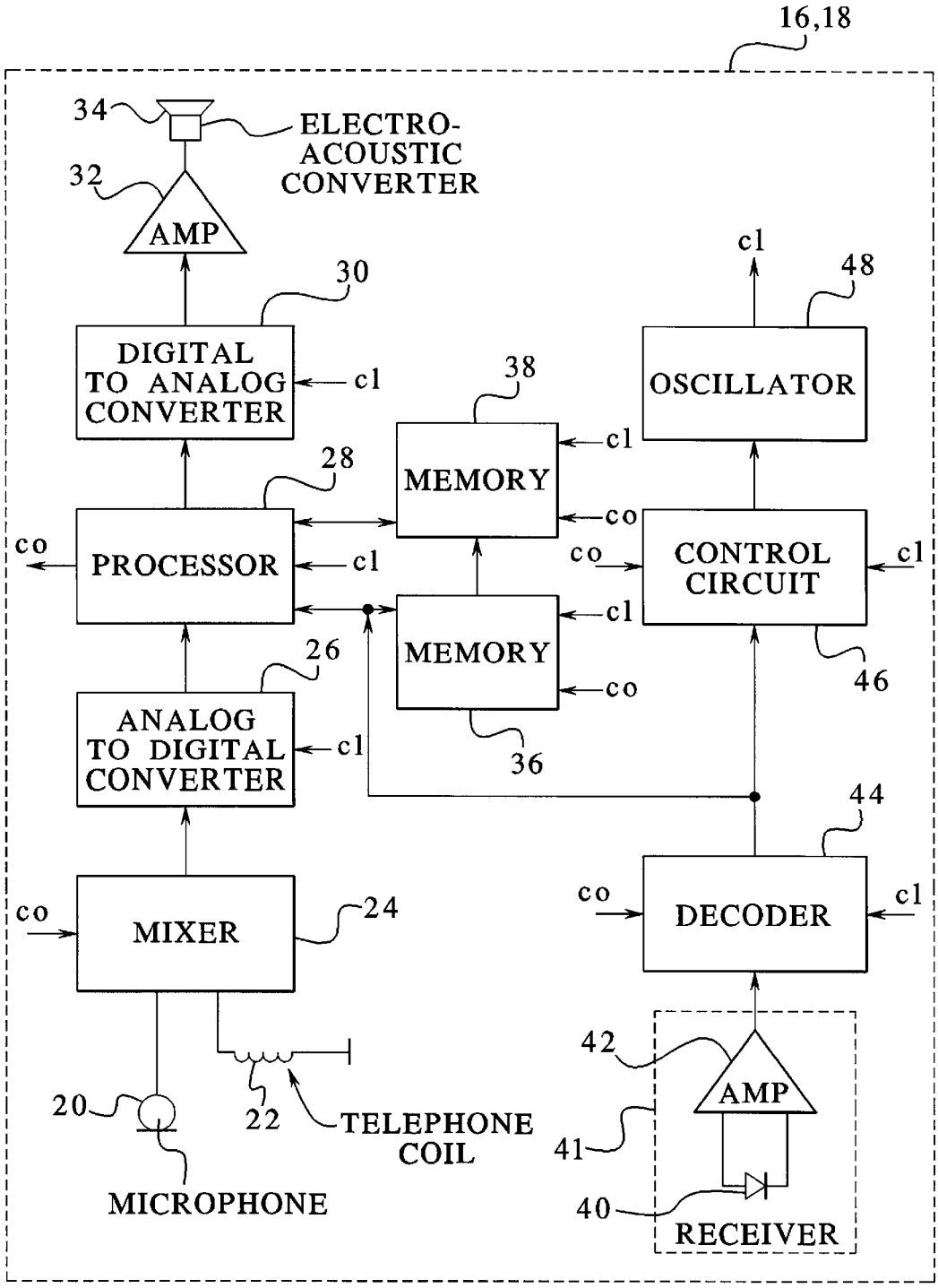
FIG. 2 shows a block diagram of an example of a hearing aid in accordance with the invention.

The hearing aid 16, 18 shown in FIG. 2 comprises a mixer 24 to which a microphone 20 and a telephone coil 22 for receiving sounds are coupled. The sounds received are converted by this microphone 20 and the telephone coil 22 into electric signals which are first amplified in the mixer 24, whereafter one or both electric signals are selected for further processing by an analog-to-digital converter 26. This selection is controlled by a programmable processor 28 via control signals co.

In the analog-to-digital converter 26, the analog electric signal originating from the mixer 24 is converted into a digital signal. Subsequently, this digital signal is processed by the programmable processor 28 and, next, converted back to an analog signal by a digital-to-analog converter 30, whereafter said signal is amplified by an output amplifier 32 and, subsequently, converted to sound by an electro-acoustic converter 34.

The operation in which the digital signal is processed by the programmable processor 28 is controlled by a hearing algorithm stored in a first memory means 38. The execution of this hearing algorithm by the programmable processor 28 determines the transfer function of the hearing aid 16, 18. During the execution of the hearing algorithm by the programmable processor 28, intermediate results can be stored in a second memory means 36. Both memory means 36 and 38 are implemented as RAM-memories and are controlled from the programmable processor 28 by means of control signals co.

Reference or control signals originating from a remote control can be received by a receiver 41. In this example, the receiver 41 is constructed so as to receive infrared signals. For this purpose, the receiver 41 comprises a receiving diode 40 which can suitably be used to receive said infrared signals. The receiver 41 further comprises an amplifier 42 which amplifies the infrared signals received by the receiving diode 40.

The reference or control signal received by the receiver 41 is checked and decoded in the decoder 44. The information contained in the reference or control signal received is subsequently sent to the programmable processor 28. The programmable processor 28 checks whether the address contained in the reference or control signal corresponds to the address of the hearing aid 16, 18. This is because the hearing aid 16, 18 has a unique address which is implemented by the presence or absence of a number of connections in the hearing aid 16, 18. If the addresses correspond with each other, the information contained in the reference or control signal can be used for further processing by the programmable processor 28.

By means of the reference or control signal, a hearing algorithm can be sent from the remote control 14 to the hearing aid 16, 18. During reception of such a reference or control signal containing a hearing algorithm, the hearing algorithm is temporarily stored in the second memory means 36 by the programmable processor 28. The hearing algorithm in the second memory means 36 is not copied to the first memory means 38 until the complete hearing algorithm has been properly received and completely stored in the second memory means 36, whereafter the newly received hearing algorithm determines the transfer function of the hearing aid.

The hearing aid 16, 18 in accordance with the invention further comprises a controllable oscillator 48 which generates a clock signal cl for the various digital components. For the proper functioning of the hearing aid 16, 18, it is important that the frequency of the clock signal cl remains within certain limits. However, as a result of variations, for example, in the supply voltage and the temperature, the frequency may extend beyond these limits in the case of the hearing aid 16, 18 in accordance with the invention. To preclude this, the hearing aid 16, 18 also comprises a control circuit 46 which is coupled to the decoder 44 and the controllable oscillator 48. Each time that a reference or control signal is received from the remote control 14, the frequency of the clock signal cl is measured in this control circuit 46 by means of a frequency of the reference or control signal. As the frequency of the reference or control signal is governed directly by the frequency of a crystal incorporated in the remote control 14, the frequency of the reference or control signal can suitably be used as a reference.

If the measurement of the frequency of the clock signal cl reveals that said frequency deviates from a reference frequency, then a control value is determined in the control circuit 46 by means of which the controllable oscillator 48 adjusts the frequency of the clock signal cl.

The controllable oscillator 48 comprises a current-controlled three-inverter ring oscillator, enabling the supply current to determine the frequency of the clock signal cl generated by the controllable oscillator 48. The supply current can be logarithmically programmed in a number of steps. This means that by programming the supply current so as to be one step higher or one step lower, the frequency of the clock signal cl is increased or decreased, respectively, by a fixed percentage.

Figure 3:
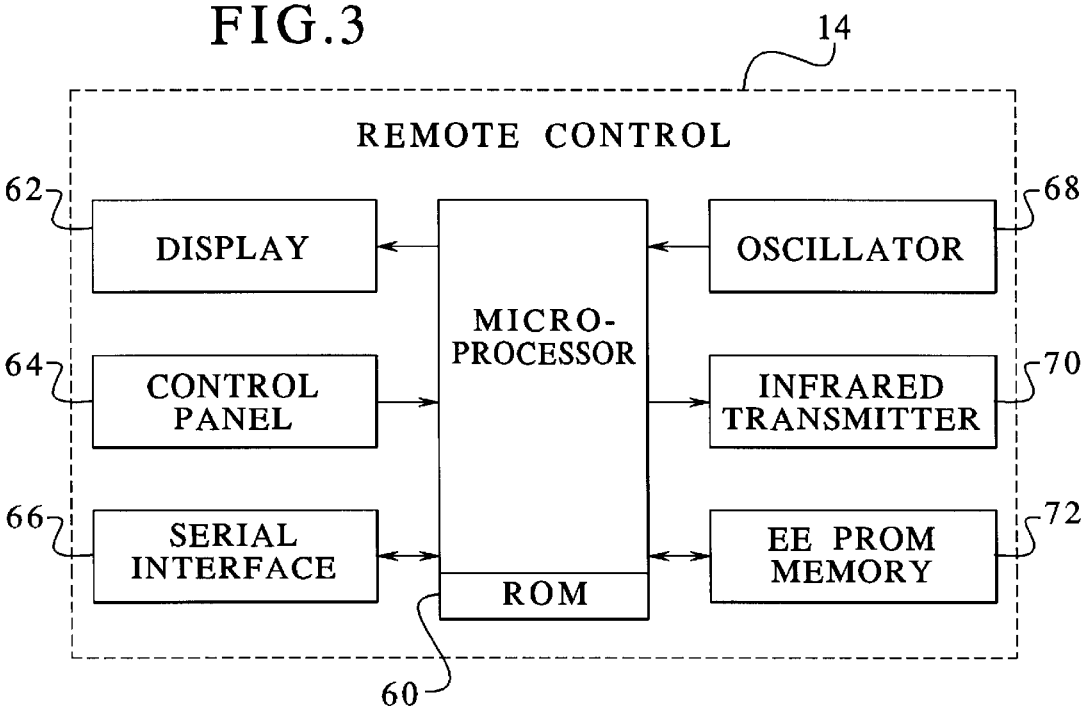
FIG. 3 shows a block diagram of an example of a remote control in accordance with the invention.

The remote control 14 shown in FIG. 3 comprises a microprocessor 60 to which there is coupled a display 62, a control panel 64, a serial interface 66, a crystal oscillator 68, an infrared transmitter 70 and an EEPROM memory 72. All functions of the remote control 14 are co-ordinated by a program which is carried out by the microprocessor 60. This program is stored in a ROM-memory incorporated in the microprocessor 60. Said microprocessor 60 is provided with a clock signal having a stable frequency by means of the crystal oscillator 68.

The EEPROM-memory 72 is arranged so as to store at least two hearing algorithms. From a computer system 12, these hearing algorithms can be loaded into the EEPROM-memory 72 by means of the serial interface 66.

The display 62 can be used to show all kinds of data. For example, it can be used to show the volume level of the hearing aid 16, 18.

The various functions of the remote control can be activated by means of the control panel 64. Said control panel 64 comprises a number of buttons by means of which the volume of the hearing aid 16, 18 can be adapted. Said control panel 64 further includes a button by means of which the hearing aid 16, 18 can be brought into a stand-by state, and a number of buttons for selecting the sound-reception source (microphone 20 and/or telephone coil 22) of the hearing aid 16, 18. If these buttons are operated, a control signal corresponding to the selected function is sent to the hearing aid 16, 18 via the infrared transmitter 70. Once the hearing aid 16, 18 has received the control signal, the function corresponding to said control signal is activated.

The control panel 64 additionally comprises a number of buttons (selection means) by means of which the hearing aid 16, 18 can be adapted to different sound conditions. If such a button is operated, a hearing algorithm corresponding to this button is read from the EEPROM-memory 72 by the microprocessor 60, whereafter it is sent to the hearing aid 16, 18 via the infrared transmitter 70. In the hearing aid 16, 18, the transfer function of the hearing aid 16, 18 is subsequently determined by the hearing algorithm.

The remote control 14 can suitably be used to control one or two hearing aids 16, 18. If the remote control 14 is used to control a hearing aid 16 and a further hearing aid 18, then, operating the last-mentioned button causes a hearing algorithm corresponding to this button to be sent to the hearing aid 16, whereafter a further hearing algorithm which also corresponds to this button is sent to the further hearing aid 18. This further hearing algorithm does not have to be equal to the hearing algorithm sent to the hearing aid 16. In this manner, the transfer functions of both hearing aids 16, 18 can be adapted to changing sound conditions by means of a single selection means.

Figure 4:
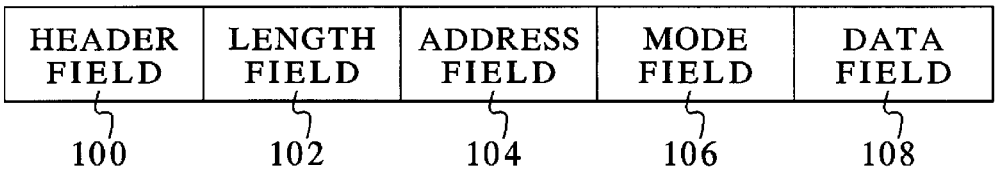
FIG. 4 schematically shows an example of a logical construction of a reference or control signal sent by a remote control in accordance with the invention and received by a hearing aid in accordance with the invention.

FIG. 4 schematically shows the logical construction of a reference or control signal sent by a remote control 14 and received by a hearing aid 16, 18 in accordance with the invention. The reference or control signal successively comprises a header field 100, a length field 102, an address field 104, a mode field 106 and a data field 108. All these fields comprise a number of information bits. The contents of the header field 100 is the same for all reference or control signals. The hearing aid 16, 18 can distinguish reference or control signals originating from a remote control 14 suited to operate such a hearing aid 16, 18, from other signals originating, for example, from remote controls for television and audio equipment.

The length field 102 includes an indication for the cumulative sum of the number of information bits in the address field 104, the mode field 106 and the data field 108. The number of information bits in the data field 108 is governed by the contents of the mode field 106. By means of the information in the length field 102, it can be determined in the hearing aid 16, 18 whether a reference or control signal has been correctly received.

The address field 104 contains the address of the hearing aid 16, 18 for which the reference or control signal is intended. As each hearing aid 16, 18 has a unique address, it is possible to decide on the basis of the contents of the address field 104 whether the reference or control signal should be subjected to further processing operations or whether further processing is not necessary because the reference or control signal is not intended for this hearing aid 16, 18.

The mode field 106 may comprise one of the following values: program mode, volsource mode or stand-by mode. If the contents of the mode field 106 is equal to the program mode, then the data field 108 contains a hearing algorithm. This hearing algorithm is stored in a first memory means 38 by the hearing aid, and is subsequently executed by the programmable processor 28. If the contents of the mode field 106 is equal to the volsource mode, then the data field 108 contains information regarding the sound-reception source (microphone 20 and/or telephone coil 22) and volume level to be used. This information is used by the programmable processor 28 to change the setting of the hearing aid 16, 18 in a corresponding manner. If the contents of the mode field 106 is equal to the stand-by mode, then the contents of the data field 108 is empty. After receiving such a reference or control signal, the hearing aid 16, 18 will be switched into the stand-by state. In this state, the hearing aid 16, 18 is in the off-position. In this state, the energy consumption of the hearing aid 16, 18 is minimal, while all settings of the hearing aid 16, 18 are preserved.

The reference or control signal sent by the remote control 14 and received by the hearing aid 16, 18 consists of a 100% modulated square-wave of 36 kHz. This reference or control signal is coded in such a manner that an information bit is represented by sixteen periods of the reference or control signal.

What is claimed is:

1. A hearing aid comprising: a first memory means and a receiver which is coupled thereto and which serves to receive wireless control signals from a remote control and which serves to store the control signals in the first memory means, characterized in that the hearing aid further comprises a programmable processor, and the control signals include a first set of instructions which can be executed by the programmable processor, and wherein the hearing aid also comprises a second memory means for temporarily storing a second set of instructions which can be executed by the programmable processor and which are received from the remote control via the control signals, said hearing aid being operative so as to store the second set of instructions which can be executed by the programmable processor in the first memory means after said second set of instructions has been completely received.

2. A remote control for control of a hearing aid, comprising:

means for coupling the remote control to a device for loading into the remote control at least a first and a second set of instructions for execution by a programmable processor located in the hearing aid, means for storing at least said first and second sets of instructions, a transmitter for transmitting to the hearing aid said first and second stored sets of instructions, and at least one selection means for selecting one of the stored sets of instructions for transmission to the hearing aid for execution by the programmable processor therein.

3. A remote control as claimed in claim 2 for control of a further hearing aid which comprises a further programmable processor, wherein the remote control comprises a single selection means for selecting a set of instructions which can be executed by the programmable processor and which are to be sent to the hearing aid, and for selecting a further set of instructions which can be executed by the further programmable processor and which are to be sent to the further hearing aid.

4. A remote control for controlling a hearing aid, comprising: a transmitter, wherein the remote control can be coupled to and decoupled from a device for loading into the remote control at least one set of instructions which can be executed by a programmable processor located in the hearing aid, the transmitter being operative so as to send the set of instructions to the hearing aid which can be executed by the programmable processor in the hearing aid, and further comprising:

means for storing at least two sets of instructions corresponding to different control functions of the hearing aid, and selection means for selecting, under control by a user of the hearing aid, one of the stored sets of instructions, wherein the transmitter transmits the selected one of the stored sets of instructions to the hearing aid for execution by the programmable processor therein.

5. A remote control as claimed in claim 4 wherein one of said two sets of instructions control the volume of the hearing aid and a second one of said two sets of instructions controls the transfer function of a signal path in the hearing aid between an input microphone and an output speaker thereof.

6. A hearing aid comprising: a first memory means and a receiver which is coupled thereto and which serves to receive wireless control signals from a remote control and which serves to store the control signals in the first memory means, characterized in that the hearing aid further comprises a programmable processor, and the control signals include a first set of instructions which can be executed by the programmable processor, and further comprising a signal path between an input microphone and an output speaker, said signal path including an analog/digital converter and a digital/analog converter and wherein said signal path further comprises said programmable processor, said hearing aid further comprising second memory means for temporary storage of a second set of instructions received from the remote control for execution by the programmable processor, said first and second memory means being coupled to the programmable processor, and a control oscillator controlled by control signals from the remote control for generating clock signals for control of the programmable processor and the first and second memory means.

7. A hearing aid as claimed in claim 6 wherein the programmable processor derives further control signals for control of the first and second memory means.

8. A hearing aid comprising: a first memory means and a receiver which is coupled thereto and which serves to receive wireless control signals from a remote control and which serves to store the control signals in the first memory means, characterized in that the hearing aid further comprises a programmable processor, and the control signals include a first set of instructions which can be executed by the programmable processor and further comprising:

a control circuit having a control input coupled to an output of said receiver and responsive to the control signals received by the receiver from said remote control, and a frequency controllable oscillator having an input for receiving a control signal from an output of the control circuit which supplies a frequency controlled clock signal to said programmable processor which is determined by the control signals received from said remote control.

* * * * *